US005163487A

United States Patent [19]

Clüsserath

[11] Patent Number: 5,163,487

[45] Date of Patent: Nov. 17, 1992

[54] METHOD AND APPARATUS FOR DISPENSING A LIQUID INTO CONTAINERS IN AN ASEPTIC OR STERILE MANNER

[75] Inventor: Ludwig Clüsserath, Bad Kreuznach, Fed. Rep. of Germany

[73] Assignees: Seitz Enzinger Noll Maschinenbau Aktiengesellschaft, Mannheim; Deutsche Granini GmbH & Co. KG, Bielefeld, both of Fed. Rep. of Germany

[21] Appl. No.: 715,447

[22] Filed: Jun. 14, 1991

Related U.S. Application Data

[60] Division of Ser. No. 552,326, Jul. 12, 1990, Pat. No. 5,031,673, which is a continuation of Ser. No. 328,477, Mar. 24, 1989, abandoned.

[30] Foreign Application Priority Data

Mar. 24, 1988 [DE] Fed. Rep. of Germany ..... 3809852

[51] Int. Cl.[5] ..... B67C 3/10

[52] U.S. Cl. ..... 141/92; 141/48; 141/39

[58] Field of Search ..... 141/5, 6, 11, 82, 85, 141/89-92, 144, 145, 39-41, 44-64, 95, 198, 288, 301, 302, 307-309

[56] References Cited

U.S. PATENT DOCUMENTS

| | | | |
|---|---|---|---|
| 531,717 | 1/1895 | Clauss et al. | 141/275 X |
| 1,022,968 | 4/1912 | Neumayer | 141/49 |
| 1,166,607 | 1/1916 | La Porte | 141/277 |
| 2,012,247 | 8/1935 | Muller | 141/47 |
| 2,330,726 | 9/1943 | McKinnis | 141/92 |
| 2,556,038 | 6/1951 | Kollsman | 141/46 X |
| 2,695,743 | 11/1954 | Wetherby-Williams | 141/40 |
| 2,770,263 | 11/1956 | Breeback | 141/48 |
| 2,794,455 | 6/1957 | Day et al. | 141/277 |
| 2,801,651 | 8/1957 | Street | 141/145 |
| 3,356,510 | 12/1967 | Barnby | 141/11 |
| 3,486,840 | 12/1969 | Burton et al. | 141/85 |
| 3,860,047 | 1/1975 | Finkelmeier et al. | 141/47 |
| 3,886,982 | 6/1975 | Uth et al. | 141/39 |
| 3,993,111 | 11/1976 | McLennand | 141/90 |
| 4,693,054 | 9/1987 | Spargo | 141/6 X |
| 4,987,934 | 1/1991 | Groom | 141/89 |
| 4,989,650 | 2/1991 | Weiss | 141/6 |

FOREIGN PATENT DOCUMENTS

| | | | |
|---|---|---|---|
| 0572988 | 11/1958 | Belgium | 141/85 |
| 1054910 | 4/1959 | Fed. Rep. of Germany | 141/85 |

*Primary Examiner*—Henry J. Recla
*Assistant Examiner*—Casey Jacyna
*Attorney, Agent, or Firm*—Robert W. Becker & Associates

[57] ABSTRACT

A method and apparatus to aseptically dispense liquid under counterpressure into a container. In a sterilization phase that precedes the filling, the inner surfaces of a container, the container mouth, as well as an outer surface of the container adjacent to the mouth thereof, are acted upon by a hot, pressurized, gaseous or vaporous sterilization medium. During both the sterilization and filling phases, the respective container is thereby completely disposed in a chamber in such a way that the interior of the container communicates via the mouth thereof with the interior of this chamber. The sterilization medium is introduced into the container at a distance from the mouth thereof via a filling tube that later serves for filling. At least during a portion of the sterilization phase, but also during the subsequent filling phase, the chamber is closed to the atmosphere in such a way that at least during this portion of the sterilization phase, a sterilization medium pressure that is greater than atmospheric pressure is set in the chamber, and during the filling phase the dispensing of the liquid into the respective container is effected against a counterpressure that exists within the chamber.

21 Claims, 4 Drawing Sheets

| | a | | b | | c | | d | | e | | f | | g | | h | |
|---|---|---|---|---|---|---|---|---|---|---|---|---|---|---|---|---|
| Valves | | | | | | | | | | | | | | | | |
| 38 | | 0 | X | | | 0 | | 0 | | 0 | | 0 | | 0 | | 0 |
| 39 | | 0 | | 0 | X | | | 0 | | 0 | | 0 | | 0 | | 0 |
| 40 | | 0 | X | | | 0 | X | | X | | | 0 | | 0 | | 0 |
| 41 | | 0 | | 0 | | 0 | X | | | 0 | | 0 | | 0 | | 0 |
| 48 | | 0 | | 0 | | 0 | | 0 | | 0 | | 0 | | 0 | X | |
| 57 | | 0 | | 0 | | 0 | | 0 | | 0 | X | | | 0 | | 0 |
| 69 | | 0 | | 0 | | 0 | | 0 | | 0 | | 0 | X | | | 0 |
| Method step | 5,8,10-12 | | 1,15-18 | | 2-4 | | 13-14 | | (14) | | 9 | | 7 | | (5),6 | |

Fig. 4

METHOD AND APPARATUS FOR DISPENSING A LIQUID INTO CONTAINERS IN AN ASEPTIC OR STERILE MANNER

This is a Divisional of Ser. No. 552,326, filed Jul. 12, 1990, allowed on May 6, 1991 now Pat. No. 5,031,673, which is a continuation of Ser. No. 328,477 filed Mar. 24, 1989, now abandoned.

BACKGROUND OF THE INVENTION

The present invention relates to dispensing a liquid under counterpressure into a container, such as a bottle, in an aseptic or sterile manner. The container that is to be filled is acted upon, at least during a portion of a sterilization phase that precedes a filling phase where the container is filled with the liquid, in a chamber that is adapted to be closed off to the atmosphere, with a hot, gaseous or vaporous sterilization medium that is under pressure, with this medium acting upon an inner surface of the container that delimits the interior thereof, upon the mouth of the container, and also on the outer surface of the container adjacent to the mouth thereof. The chamber is disposed below a filling element that in the filling phase delivers the liquid into the interior of the container via a filling tube that extends through the mouth of the container into the interior thereof. The apparatus for carrying out this method includes: a container entry mechanism for supplying the containers that are to be filled: a container outlet mechanism for the discharge of filled and capped containers; a rotor that rotates about a vertical axis of rotation; a plurality of filling elements disposed about the periphery of the rotor, with each filling element including a liquid flow valve for controllable dispensing of the liquid via a liquid channel and a filling tube connected thereto; associated with each filling element a container support that is movable toward and away from the filling element in a vertical direction, with the containers that are to be filled being delivered to the rotor at a container infeed or entry position and being withdrawn from the rotor at a container release or discharge position; below each filling element, a respective chamber that is formed on the rotor and is a bell-shaped portion having a closed upper end adjacent to the filling element and an open bottom end that is remote from the filling element: on each filling element, a sterilization medium delivery means that includes at least one control valve arrangement and that serves for supplying a sterilization liquid to the container and the bell-shaped portion during a sterilization phase that precedes the filling phase; and a mechanism for closing or capping the containers after the same have been filled with the liquid.

In the beverage industry, the problem frequently arises of dispensing beverages, such as fruit juices or the like, in a non-heated state and without the use of chemical additives, into containers or bottles in such a way that an adequate life of the dispensed and capped product is assured. One precondition for this is that during the introduction of the liquid, the containers are very sterile, i.e. free of bacteria, and that this sterility is also retained until the containers are closed or capped.

In one known method for filling bottles with a liquid that is under pressure using a counterpressure filler (U.S. Pat. No. 2,695,743), the respective bottle that is to be filled and that is disposed in an upright condition below a filling element has that part of its neck that is provided with the container or bottle mouth in a closed chamber during a sterilization phase that precedes the filling phase. Furthermore, a sterilization medium in the form of steam is introduced into the interior of the bottle via a filling tube, which, incidentally, can be only very short due to the control of the liquid flow valve of the filling element. In this connection, the steam flows through the mouth of the bottle, and also into the closed chamber about this bottle mouth, and can escape from this chamber to the atmosphere via a check valve With this known method, the bottles are not preheated prior to the sterilization phase. One of the drawbacks of this heretofore known method is that only that portion of the bottle neck that is immediately adjacent to the mouth of the bottle is received by the very small, closed chamber, and in particular only a very short part of the filling tube extends into the interior of the bottle during the sterilization phase so that the lower, open end of the filling tube is spaced from the bottom of the bottle by a distance that is many times greater than the difference between the open end of the filling tube and the mouth of the bottle. Already for this reason, as well as due to the fact that in the small chamber only that portion of the bottle neck that is immediately adjacent the mouth of the bottle is received, an only insufficient sterilization of the respective bottle results, and in particular, among others, for the reason that the sterilization medium flows about the bottles that are to be treated in an only inadequate manner, as well as that an insufficient heating of the treated bottles is achieved at their critical surfaces or regions. Finally, this known method can be carried out only with a relatively complicated and expensive construction, in particular due to the necessity for a plurality of movable parts at the filling element and also for the reason that a special holding element is required for the bottle closure in the sterilization chamber.

It is therefore an object of the present invention to provide a method and apparatus of the aforementioned general type with which an aseptic dispensing of a liquid under counterpressure into a container, especially a bottle, can be achieved in a straightforward manner and in a particularly reliable manner without the use of chemical agents.

BRIEF DESCRIPTION OF THE DRAWINGS

This object, and other objects and advantages of the present invention, will appear more clearly from the following specification in conjunction with the accompanying schematic drawings, in which:

FIG. 4 is a table showing various operational states of a control valve arrangement.

SUMMARY OF THE INVENTION

Figure 1:
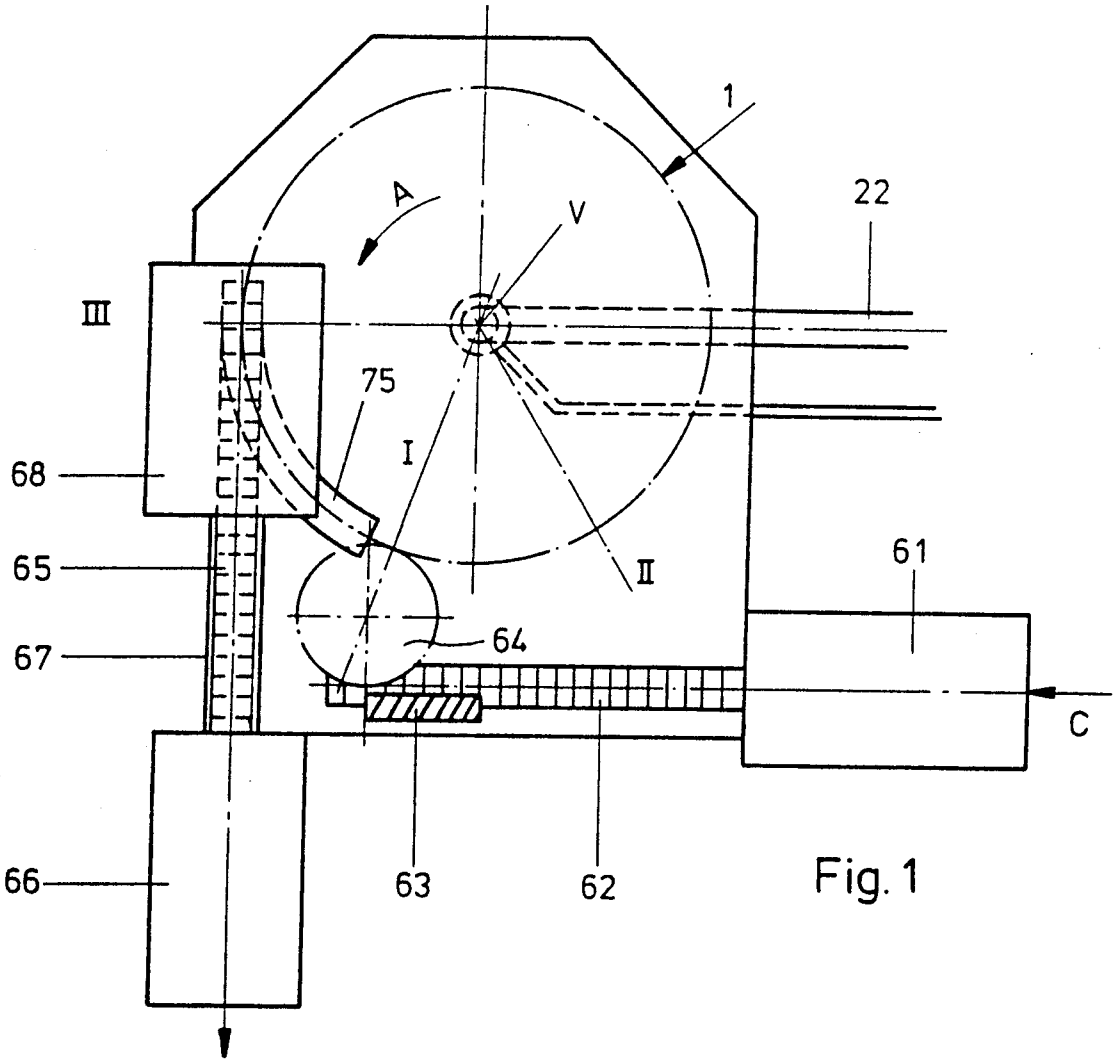
FIG. 1 is a diagrammatic plan view of one exemplary embodiment of an inventive bottle-filling machine for the aseptic dispensing of liquids into bottles.

The method of the present invention is characterized primarily by the steps of: during the sterilization phase as well as during the filling phase, accommodating a container completely in a chamber in such a way that the interior of the container communicates via the mouth thereof with the interior of the chamber; during said sterilization phase introducing the sterilization medium via the filling tube into the interior of the container at a distance from the mouth; and in the filling phase, with the chamber closed-off to the atmosphere, effecting dispensing of the liquid into the container against a counterpressure that exists in the interior of the chamber.

Since with the inventive method during the sterilization phase the hot sterilization medium, which is preferabably steam, and preferably saturated steam, is introduced through the filling tube into the interior of the container in such a way that it exits the filling tube directly at the bottom of the container, there results during the sterilization phase a uniform and intensive stream of the hot sterilization medium along all of the surfaces and regions of the container that are critical for keeping the container free of bacteria, so that in particular also taking into account a preferred preheating of the container in a preheating phase, a high degree of freedom from bacteria is achieved within a short treatment time. A primary contributing factor to this is that at least during a portion of the sterilization phase the chamber is closed, and during the sterilization phase, i.e. during this portion of the sterilization phase, a relatively high sterilization medium pressure, and hence also a high sterilization medium temperature, can be set in the chamber. However, another important feature of the present invention is that during the filling phase that follows the sterilization phase, the chamber is similarly closed, so that dispensing of the liquid can be effected under counterpressure by using for this purpose the pressure that exists or is established in the chamber. As a result, during the sterilization and filling phases in each case the same conditions are obtained with respect to the positioning of the container, in particular also in relation to the respective filling element and its pulse. This makes a particularly simple control of the respectively used filling machine possible, and in particular it is also not necessary, for the filling phase and a preceding pressurizing, to bring the mouth of the container into a sealing position with the filling element or a surface of this filling element that surrounds the filling tube.

Pursuant to one specific embodiment of the present invention, the counterpressure that is needed for the filling phase is formed by the pressure of the sterilization medium, which pressure has been established in the chamber at the conclusion of the sterilization phase. In this case, the filling phase then immediately follows the sterilization phase.

Pursuant to another specific embodiment of the present invention, after termination of the sterilization phase the sterilization medium is removed or withdrawn from the chamber, and in particular either by opening the chamber to the atmosphere, or by introducing a partial vacuum into the chamber. In so doing, the two aforementioned method steps preferably chronologically follow one another, whereby due to the provision of the chamber with a partial vacuum, i.e. due to the connection of the chamber to a source of vacuum, also after the discharge of the sterilization medium to the atmosphere, residues of sterilization medium or of condensate (water) of the sterilization medium that might still remain in the chamber or in the interior of the container can be reliably completely removed. After the discharge or removal of the sterilization medium, and with the chamber then closed, there is effected a pressurizing of this chamber with a pressurized medium, namely with an inert gas (for example $CO_2$) or with sterile air. The filling phase is then initiated after this pressurizing of the chamber.

The apparatus of the present invention is characterized primarily in that the interior of each bell-shaped portion or chamber has a height that is at least somewhat greater than the height of a container that is to be filled, with the open end of the bell-shaped portion being adapted to be closed relative to the atmosphere by the container support; and the control valve arrangement has a first portion, and the liquid channel has a portion that in the direction of flow of the liquid is disposed after the liquid flow valve and that is adapted to communicate via the first portion of the control valve arrangement with the sterilization medium delivery means.

Further specific features of the present invention will be described in detail subsequently.

DESCRIPTION OF PREFERRED EMBODIMENTS

Figure 2:
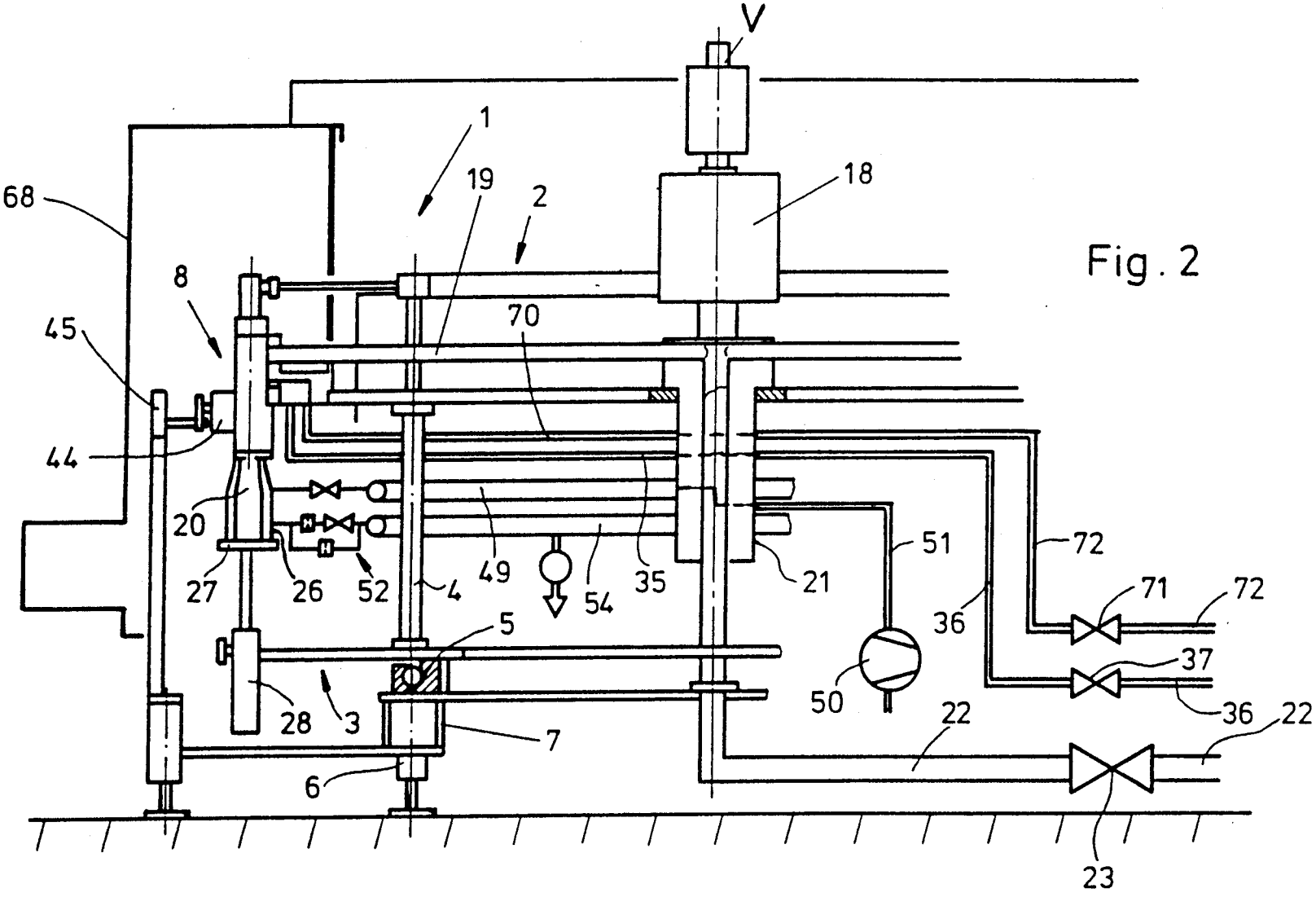
FIG. 2 is a partially sectioned side view of the bottle-filling machine of FIG. 1.
Figure 3:
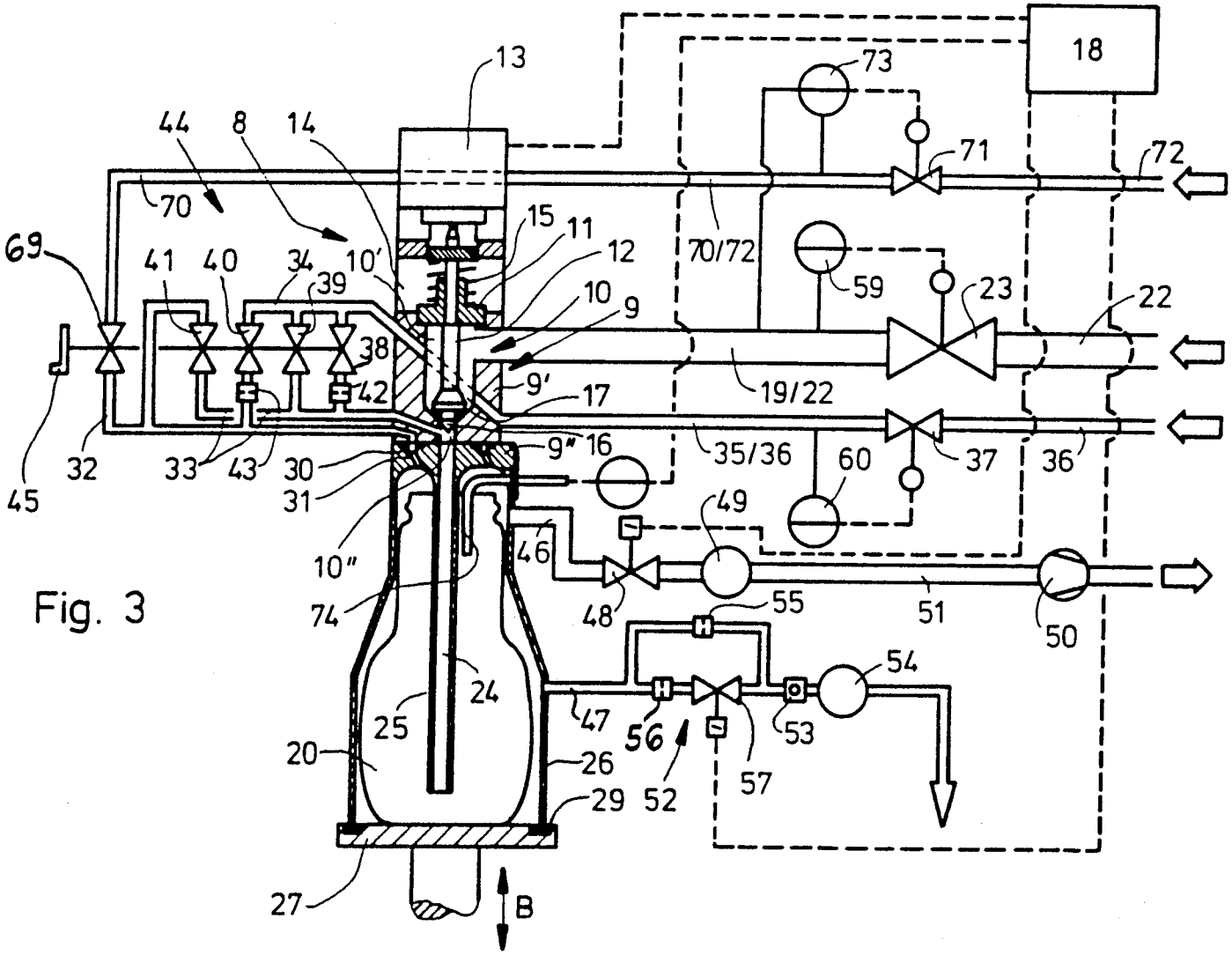
FIG. 3 is a simplified cross-sectional view through a filling element that is provided on the periphery of the rotor that rotates about a vertical axis of rotation, and also shows a bottle as well as the essential elements that control the sterilization and filling phases, with these elements being functionally represented for a better understanding.

Referring now to the drawings in detail, the filling machine illustrated in FIGS. 1-3 is provided with a rotor 1 that rotates in the direction of the arrow A about a vertical axis of rotation V. In the illustrated embodiment, the rotor 1 essentially has two rotor sections 2, 3 that are disposed above one another in a vertical direction, and that are interconnected via several vertical support columns 4 in such a way that their height can be adjusted. By means of a ball bearing turning gear arrangement 5 that is provided on the lower rotor section 3, the rotor is rotatably mounted about the vertical axis of rotation V on a stationary machine frame 6 in the region of a base ring 7 thereof. A plurality of identical filling elements 8 are provided on the outer periphery of the upper rotor section 2. These filling elements 8 are staggered relative to one another about the axis of rotation V in a uniform angular spacing. Each filling element B is provided with a valve housing 9 in which is formed a channel 10 that is open toward both the upper side and lower side of the valve housing 9. The channel 10 is essentially composed of the two portions 10' and 10''. On the upper side, i.e. in the region of the portion 10', the channel is tightly closed off by a closure element Il through which, for example accompanied by the use of a non-illustrated separating membrane, extends a valve stem 12, the upper end of which cooperates with an actuating device 13 that is provided with an electromagnet and that is secured to the upper side of a housing part 14 that is seated on the upper side of the valve body or housing 9. When the actuating device 13 is activated, the valve stem 12, by the action of a compression spring 15 that is accommodated in the housing part 14, is moved upwardly by a certain amount out of the rest position illustrated in Fig. 3. At its lower end, which is provided within the valve housing 9 or the channel 10, the valve stem 12 is provided with a valve body 16, the approximately truncated-cone peripheral surface of which, in the rest position of the valve stem 12 illustrated in FIG. 3, rests sealingly against a valve seat 17 that is formed by a frusto-conical surface of the channel 10 in the region of a narrowing-down of this channel between the portions 10' and 10'' thereof. In the rest position of the valve stem 12 illustrated in FIG. 3, the liquid flow valve that is formed by the valve body 16 and the valve seat 17 is closed. By activating the actuating device 13, this liquid flow valve can be opened by the action of the compression spring 15, thereby establishing communication between the portions 10′ and 10″ of the channel 10. The individual actuating devices 13 are controlled by an electronic control mechanism 18 in a manner that will be described subsequently.

The upper end of the channel 10 of each filling element 8 is connected with one end of a conduit 19 via which the liquid material, for example fruit juice that is to be dispensed into the bottles 20 is supplied to the respective filling element B. Via a rotary distributor 21 that is provided in the region of the axis of rotation V, the other end of all of the conduits 19 is connected to a common, fixed material or liquid conduit 22 that leads via a shutoff valve 23 to a non-illustrated supply tank for the material that is to be dispensed.

At the lower end, i.e. in the region of the portion 10″, the upper, open end of a channel 24 of a vertical filling tube 25, the bottom end of which is similarly open, opens into the channel 10. In the region of its upper end, the filling tube 25 is suitably held on the valve housing 9 in such a way that it is preferably replaceable.

In the illustrated embodiment, the valve housing 9 is embodied in two parts, i.e. this valve housing comprises the upper part 9′, which is provided not only with the portion 10′ of the channel 10 but also with the valve seat 17, as well as a lower part 9″ in which the portion 10″ of the channel 10 is essentially formed and on which the upper end of the filling tube 25 is secured. That side of the lower part 9″ remote from the upper part 9′ is embodied as a bell-shaped portion 26 that is open toward the bottom and concentrically extends about the entire length of the filling tube 25. The bell-shaped portion 26 is embodied in such a way that the interior thereof has a height in the vertical direction that is somewhat greater than the height of the upright bottles 20. In addition, the inner cross-sectional configuration of the bell-shaped portion 26 is adapted to the outer cross-sectional configuration of the bottles 20 in such a way that the bell-shaped portion 26 of each filling element 8 can receive the full height of a respective bottle 20 and can sealingly surround the same, as illustrated in FIG. 3.

Provided below each filling element 8 is a bottle plate 27 that, via a known lifting mechanism 28 that is provided on the rotor section 3 and is controlled in a known manner, can be raised and lowered in a vertical direction, in the direction of the double arrow B, and in particular in such a way that in the uppermost raised position of the respective bottle plate 27, the upper side thereof that forms the support surface for the bottles 20, i.e. with a sealing ring 29 that is provided at that location, sealingly rests against the rim of the bell-shaped portion that extends about the lower opening thereof, thereby sealing off the interior of the bell-shaped portion 26.

Formed in the region of the horizontal plane of separation between the two parts 9′ and 9″ of the valve housing 9 is an annular channel 30 that extends concentrically about the channel 10. The upper ends of a plurality of channels 31, which are uniformly distributed in the part 9′ about the portion 10′ of the channel 10, open into the annular channel 30. The lower ends of the channels 31 respectively open at different angles at that surface of the part 9′ that delimits the top of the interior of the bell-shaped portion 26, with the channels 31 opening out in such a way that these openings of the channels 31 are distributed about the filling tube 25. The annular channel 30 is in communication with a channel 32. One end of a further channel 33 communicates with the portion 10″ of the channel 10. In the illustrated embodiment, in the direction of flow in which the liquid material flows through the channel 10 when the liquid flow valve is opened, this channel 33 opens into the portion 10″ of the channel 10 immediately after the valve seat 17.

Each filling element 8 is furthermore provided with a channel 34 that is connected to one end of a conduit 35 via which steam is conveyed to the respective filling element 8, with the other end of the conduit 35 being connected via the rotary distributor 21 with a common, fixed steam line 36 that is connected via a shutoff valve 37 to a nonillustrated apparatus for generating steam (saturated steam). The two channels 33 and 34 can be interconnected via valves 38 and 39, the two channels 32 and 34 can be interconnected via a valve 40, and the two channels 32 and 33 can be interconnected via a valve 41, whereby these valves can be controlled separately, and in the connection formed by the valve 38 a throttle mechanism 42 is provided while in the connection formed by the valve 40 a throttle mechanism 43 is provided. Each of the two throttle mechanisms 42 and 48 is formed by at least one Venturi tube or a channel portion that is provided with a reduced cross-sectional configuration.

The aforementioned channels 32-34 are formed in the valve housing 9 of the respective filling element 8. Similarly, the throttle mechanisms 42 and 43 are provided in this valve housing 9. In addition, the valves 38–41, rather than being individual valves, are preferably formed by a change-over valve arrangement 44 that is embodied in the manner of a flat slide and is provided with a slide plate. The valve arrangement 44, or the slide plate thereof, has a plurality of operating positions that correspond to the respective operating or switching states of the valves 38-44, as will be described in detail subsequently. The valve arrangement 44, or an actuating lever that is connected to the control slide thereof, cooperates during rotation of the rotor 1 with control elements, for example control cams, and especially sequence switch cams, that are provided on a fixed control ring 45 at a distance from one another and/or in different planes, in order to bring the valve arrangement 44 or its slide plate into the respectively required operating position. It is to be understood that the valves 38–41 could also be individual or multiple valves that are mechanically controlled by the control elements that are provided on the control ring 45, or in this case are preferably controlled electrically or pneumatically.

Two further conduits 46 and 47 open into the interior of the bell-shaped portion 26 of each filling element B. The conduit 46 serves for providing a controlled underpressure or vacuum to the respective bell-shaped portion 26, and the conduit 47 forms a return gas or return steam line that preferably opens out into the interior of the bell-shaped portion 26 as close as possible to the lower, open end thereof. Each conduit 46, which in the illustrated embodiment opens out into the pertaining bell-shaped portion 26 above the conduit 47, is connected via a valve 48 with an annular collecting channel 49 that is provided on the rotor 1, i.e. on the upper rotor section 2, and that extends concentrically about the axis of rotation V. The collecting channel 49, in turn, is connected via the rotary distributor 21 with a fixed conduit 51 that is connected to a vacuum pump 50. It is to be understood that the rotary distributor 21 is embodied in such a way that a reliable separation of the individual media (liquid that is to be dispensed, steam, and partial vacuum) is assured within the distributor.

Via a throttle and valve mechanism 52 and a check valve 53, the conduit 47 is connected with an annular collecting channel 54 that extends concentrically about the axis of rotation V and that is similarly provided on the upper rotor section 2. The throttle and valve mechanism 52 comprises the parallel connection of a throttle mechanism 55 and a series arrangement comprised of a throttle mechanism 56 and a valve 57. The two throttle mechanisms 55 and 56 are again formed by at least one Venturi tube or a constricted conduit portion, whereby for example the throttle mechanism 55 has a diameter of 0.71 mm and the throttle mechanism 56 has a diameter of 6 mm. In the illustrated embodiment, the two valves 48 and 57 are electrically actuatable valves that are controlled by the electronic control mechanism 18. In addition to a simplification of the overall construction, the use of the collecting channels 49 and 54, which are respectively common to all of the filling elements and of which the collecting channel 54 has an outlet to the atmosphere, also has, among others, the advantage that for all of the filling elements 8 respective defined pressure conditions exist during opening of the valves 48 and 57, whereby in particular the collecting channel 54 in addition to the check valve 53 also assures that no air can be drawn in during cooling of a bell-shaped portion 26 (for example when the machine is shut down).

In principle, it is also possible to mechanically control the valves 48 and 57 during rotation of the rotor 1 by appropriate control elements that are provided on a stationary control ring, whereby the function of the valve 48 and/or 57 can also be achieved by the rotary distributor 21 if the latter is embodied as a rotary slide valve arrangement.

In the illustrated embodiment, the two valves 23 and 37 are controlled by preferably adjustable pressure regulators 59 and 60, and in particular in such a way that by opening and closing the valve 37 or the valve 23, a prescribed or adjustable steam pressure results in the conduit 35, and a prescribed or adjusted pressure for the liquid material results in the conduit 22, whereby the valve 23, via the pressure regulator 59, is also controlled as a function of the steam pressure in the conduit 35, and in particular in such a way that the valve 23 does not open until the prescribed or adjusted steam pressure is present in the conduit 35. In other words, a dispensing of the liquid material into the bottles 20 is no possible until an adequate destruction of bacteria or sterilization of the bottles 20 is assured due to the presence of a sufficient steam pressure in the conduit 35.

The bottles 20 that are to be filled are conveyed in an upright position to the filling machine via a non-illustrated transport mechanism, as indicated in FIG. 1 by the arrow C. The bottles 20 then first move through a tunnel-like preheater 61 in which the bottles are warmed or heated, which, among other things, serves to shorten the sterilization phase that precedes the filling of the bottles 20 with the liquid material (the filling phase), but also serves to avoid a possible breakage of bottles due to temperature shock during the sterilization phase. The preheated bottles 20 are then conveyed via a transporting section 62 to the bottle entry section, which is formed by a dividing screw conveyor 63 and an entry star 64. At this bottle entry section, the bottles 20 that are to be filled are successively transferred to a respectively lowered bottle plate 27. This transition position is indicated by the symbol 1 in FIG. 1.

At the bottle discharge section, i.e. at the position indicated by the symbol III in FIG. 1, the filled bottles 20 are removed from the lowered bottle plate 27 and pass via a transport element 65 to a closing or capping mechanism 66. In order to prevent heat loss prior to closing or capping of the filled bottles 20, the transport element 65 is disposed in an outwardly closed-off tunnel 67 that extends to the closing or capping mechanism 66. In addition, and for the same reason, the discharge region is covered by a hood-like housing 68. In this housing, the filled bottles 20 that have been removed from the bottle plates 27 can also be subjected to a thermal treatment, preferably by gas flames.

If during the filling of the bottles 20 a pressurizing phase is provided that precedes the actual filling phase, and during which pressurizing phase the bell-shaped portion 26, and hence also the respective bottle 20, is pressurized with an inert gas (for example $CO_2$) or with sterile air, then the channel 32 of each filling element 8 is connected via a further valve 69 to a conduit 70. This conduit 70 is then connected via the distributor 21 to a fixed conduit 72 that leads, via a shutoff valve 71, to a non-illustrated pressure source for sterile air or for inert gas. A preferably adjustable pressure regulator 73 is associated with the valve 71. With this pressure regulator 73, and by appropriate opening and closing of the valve 71, a prescribed or adjusted pressure is regulated in the conduit 72. However, the pressure regulator 73 also responds to the pressure in the conduit 22, i.e. via the pressure regulator 73 the valve 71 is controlled in such a way that the pressure in the conduit 72 is greater than the pressure in the conduit 22 by a prescribed or adjusted amount.

In the illustrated embodiment a stationary plate 75 is additionally provided between the positions III and I, and is held on the machine frame 6 in such a way that the upper surface sides of this plate 75 are disposed in horizontal planes slightly below the path of movement of the bell-shaped portions 26.

With one specific embodiment of the present invention, during rotation of the rotor 1 in the direction of the arrow A, the sterilization as well as the filling of the bottles 20 is effected during the positions I and III in a manner corresponding to the following Example I.

EXAMPLE I

1. After transfer of a bottle that is to be filled at the position I to a bottle plate 27, this bottle 20 is raised by the bottle plate 27 to such an extent that the filling tube 25 extends through the mouth of the bottle 20 into the interior thereof, yet the bottle plate 27 does not yet rest in a sealing manner against the lower rim of the bell-shaped portion 26. In other words, an opening to the atmosphere, in the form of an annular gap, still remains between the lower rim of the bell-shaped portion 26 and the bottle plate 27. During this first stage, a reduced supply of steam is constantly effected via the filling tube 25 into the interior of the bottle 20, as well as via the channels 31 into the interior of the bell-shaped portion 26, whereby for this purpose the valves 38 and 40 are opened via the throttle mechanisms 42 and 43, and a liquid flow valve of the pertaining filling element 8, as well as the valves 39, 41, 48, and 69, are closed.

2. The bottle plate 27 is moved further upwardly. Shortly before the bell-shaped portion 26 is closed off, with the liquid flow valve still closed, a non-reduced feeding of steam is effected exclusively via the filling tube 25, for which purpose the valve 39 is opened, and the valves 38, 40, 41, 48, and 57 are closed.

By means of the two steps 1 and 2 just described, on the one hand a further gentle preheating of the bottles 20 is assured, and on the other hand, condensate (water) that is possibly deposited on the surfaces of the bottle 20, and during step 2 also such condensate that has possibly formed in the interior of the bottle 20, are carried away to the outside by the stream of steam through the opening formed between the bell-shaped portion 26 and the bottle plate 27, and in particular together with air that is present in the bottle 20 or in the bell-shaped portion 26.

3. As soon as the bottle plate 27 rests sealingly against the bell-shaped portion 26 and seals off the latter, the bottle 20 and the bell-shaped portion 26 are pressurized with steam, with the liquid flow valve still being closed, and with the valves 38–41, 48, and 57 having the same position as in step 2. At this point, with the bell-shaped portion 26 closed, there is effected a discharge of steam via the throttle mechanism 55 into the collecting channel 54.

4. The condition of step 3 is maintained over a period of time, i.e. over an angular range of the rotor 1 that corresponds to this period of time, until a satisfactory sterilization of the bottle 20 is assured under the high steam pressure that exists in the bell-shaped portion 26.

5. In a further step, with the liquid flow valve still closed, the steam in the bell-shaped portion 26 is then discharged, which is effected, for example, by a renewed slight lowering of the bottle plate 27 and via the annular gap that is formed thereby between the bell-shaped portion 26 and the bottle plate 27. In this connection all of the valves 38–41, 48, and 57 are closed.

However, the discharge of the steam can also be effected via the conduit 46 with the bottle plate 27 still resting in a sealing manner against the bell-shaped portion 26, whereby in this case the valve 48 is then briefly opened.

6. With the liquid flow valve still closed, and the bell-shaped portion 26 again closed off by the bottle plate 27, the interior of the bell-shaped portion 26 is then provided with a partial vacuum, and in particular in such a way that the pressure in the bell-shaped portion 26 is approximately 0.5 bar. With this step, where the entire residual condensate (water) is removed from the bell-shaped portion 26 in the bottle 20, the valves 38–41, 57, and 65, as well as the check valve 53, are closed.

7. With the liquid flow valve still closed, a pressurizing of the closed bell-shaped portion 26, and hence also of the bottle 20, is effected with an inert gas (for example $CO_2$) or with sterile air. In so doing, the valves 38–41, 48, and 57 are closed, and the valve 69 is opened, whereby a reduced flow of sterile air or inert gas is established out of the bell-shaped portion 26 via the throttle mechanism 55 and the check valve 53.

8. With the previously described steps, the sterilization phase (steps 1–5) as well as the pressurizing phase (steps 6 and 7) that also precedes the actual filling phase, are concluded, so that approximately at the position II of FIG. 1, the filling phase is initiated by opening the filling valve of the pertaining filling element 8 by activating the actuating device 13 via the electronic control mechanism 18. At this beginning of the filling phase, all of the valves 38–41, 48, 57, and 69 are closed, so that the liquid material flows into the bottle 20 via the filling tube 25, and in particular accompanied by corresponding displacement of the inert gas or sterile air that is present there and that flows into the collecting channel 54 via the throttle mechanism 55, which initially results in a slow supplying of the liquid material, i.e. a filling of the bottle at a slow filling rate.

9. After the bottom end of the filling tube 25 becomes submerged in the liquid level, there is effected, with the liquid flow valve still opened, a filling at an increased filling rate, and in particular with the valves 38–41, 48, and 69 closed and the valve 57 open, so that the inert gas or air that is displaced by the filling material can flow off via the two throttle mechanisms 55 and 56 into the collecting channel 54.

10. After conclusion of the rapid filling phase (step 9), and with the liquid flow valve still open, the braking phase is initiated, and in particular by closing the valve 57 and with the valves 38–41, 48, and 69 still being closed.

11. After the actuation of a filling state sensor that triggers the electronic control mechanism 18 and that, in the illustrated embodiment, is formed by a sensor 74 that is provided in the respective bell-shaped portion 26 and extends through the mouth and into the bottle 20 that is to be filled, there is effected, with the liquid flow valve still open and the valves 38–41, 48, 57, and 69 closed, a correction filling phase; for example, the electronic control mechanism 18 can keep the liquid flow valve open for a prescribed period of time.

12. After conclusion of the correction period, and with the valves 38–41, 48, 57, and 69 still closed and also the liquid flow valve of the pertaining filling element 8 being closed, the pressure in the bell-shaped portion 26 is also reduced via the throttle mechanism 55.

As previously described, the sensor 74, by means of the correction phase, initiates closing of the liquid flow valve of the pertaining filling element 8. Via appropriate construction, this sensor can also serve to initiate the braking or slowing phase (step 10) that relates to the filling state. If the sensor 74 is embodied as a conductance contact, then in this case the sensor 74, in addition to a common electrode, has two controlled electrodes that are provided one above the other in the vertical direction, with the lower electrode, when it becomes immersed in the liquid level, introducing the slowing phase, and with the upper electrode, when it becomes immersed in the liquid level, initiating closing of the liquid flow valve by means of the correction phase.

13. With the liquid flow valve closed, the valves 38, 39, 48, 57, and 69 closed, and the valves 40 and 41 opened, draining of the filling tube 25 is then effected accompanied by simultaneous reduced supply of steam into the bell-shaped portion 26, and in particular via the open valve 40 and the throttle mechanism 43, whereby an increasing steam pressure results in the bell-shaped portion 26 since the steam can only flow off in a reduced manner via the throttle mechanism 55.

14. With the liquid flow valve still closed and the valves 38, 39, 48, 57, and 69 closed, the valve 41 is also closed, whereas the valve 40 remains opened, so that a reduced steam stream into the bell-shaped portion 26 still results. The bottle plate 27 is subsequently lowered.

15. If the bottle plate 27, and hence also the filled bottle 20, are lowered to such an extent that the bottom end of the filling tube 25 emerges from the liquid level, with a continued reduced steam stream into the bell-shaped portion 26, i.e. with the valve 40 still opened, the valve 38 is also opened, so that then also for a complete draining of the filling tube 25 a reduced stream of steam results through the channel 24 of this filling tube 25, and in particular preferably during the further lowering of the bottom plate 27 and the filled bottle 20. The valves 39, 41, 48, 57, and 69 are closed.

16. The filled bottle 20 is discharged or ejected at the position III, and is conveyed via the transport element 65 to the closing or capping mechanism 66. During this discharge of the filled bottles 20, the valves 38–41, 48, 57, and 69 remain in the position described in conjunction with step 15, so that a reduced stream of steam continues through the channels 31 and the channel 24 of the filling tube 25.

17. Between the positions III and I, the respective bell-shaped portion 26 is closed off except for a narrow annular gap that is formed between its lower, open end and the fixed plate 75. The position of the valves 38–41, 48, 57, and 69 described in conjunction with the step 15 is maintained, so that a reduced stream of steam can continue through the channels 31 and the channel 24 of the filling tube 25, as a result of which the steam that is discharged through the annular gap between the bell-shaped portion 26 and the plate 75 acts upon the interior and inner surfaces of the bell-shaped portion 26 and against the outer and inner surfaces of the filling tube 25. The use of the plate 75 has the particular advantage that during this step, the steam atmosphere is maintained within the respective bell-shaped portion 26, and thus, also taking into account the dimension or width of the annular gap formed between the bottom of the bell-shaped portion 26 and the plate 75, no ambient or atmospheric air, bacteria, impurities, etc. can enter into the bell-shaped portion 26 from the outside.

The present invention was described above in conjunction with one exemplary embodiment. It is to be understood that changes and modifications, especially with regard to the described method, would also be possible without thereby deviating from the underlying concept of the invention. Thus, in an embodiment of the present process that is simplified relative to the described Example I, the beginning of filling, i.e. the filling phase is initiated after step 4, i.e. without the need for steps 5–7, the steps 8–17 immediately follow step 4, i.e. the steam pressure that was established in the bell-shaped portion 26 at the end of step 4 forms the counter-pressure at the beginning of the filling phase with this simplified embodiment of the inventive process. It is to be understood then that with this embodiment the valves 69 and 71, the conduits 70 and 72, the pressure regulator 73, as well as the source for the pressurized inert gas or the pressurized sterile air are also not needed. The pressurizing of the respective bell-shaped portion with steam or inert gas prior to the initiation of the filling phase has, in contrast to the pressurizing with sterile air the particular advantage that practically no oxygen passes into the bell-shaped portion 26, and hence also no oxygen is absorbed by the filling material during the dispensing, as a result of which, among other things, the ability of the dispensed material to keep is also considerably improved.

With the previously described method, which also includes the steps 5–7 of Example I, a total of eight different operating positions are required for the control valve arrangement that is formed by the valves 38–41, 48, 57, and 69. In contrast, with the simplified method without the steps 5–7 and without the valves 48 and 69, a total of five different operating positions are sufficient for the control valve arrangement.

FIG. 4, which is in tabular form, shows the respective operating positions of the control valve arrangement and the pertaining switch positions of the valves 38–41, 48, 57, and 69 for the individual method steps 1 to 17 of the embodiment of Example I. In this graph, a "X" indicates the opened state and a "○" indicates the respectively closed state of the valves in the individual method steps, i.e. in the individual operating positions a–h that correspond to these steps and that pertain to the control valve arrangement formed by the valves 38–41, 48, 57, and 69.

In a further specific embodiment, the sterilization as well as the filling of the bottles 20 is effected in a manner corresponding to the following Example II.

EXAMPLE II

1. After transferring a bottle 20 that is to be filled to the position I on a bottle plate 27, this bottle 20 is raised by the bottle plate 27 to such an extent that the filling tube 25 extends through the mouth into the interior of the bottle 20, yet the bottle plate 27 does not yet rest sealingly against the lower rim of the bell-shaped portion 26. In other words, an annular gap that is open to the atmosphere still remains between the lower rim of the bell-shaped portion 26 and the bottle plate 27. During this first step, a reduced steam feeding via the filling tube 25 into the interior of the bottle 20 as well as via the channels 31 into the interior of the bell-shaped portion 26 is constantly effected. For this purpose, the valves 38 and 40 are opened via the throttle mechanisms 42 and 43, and the liquid flow valve of the pertaining filling element 8, as well as the valves 39, 41, 48, and 69, are closed.

2. The bottle plate 27 is raised still further. Prior to sealing-off of the bell-shaped portion 26, with the liquid flow valve still closed, there is effected a non-reduced steam feeding exclusively via the filling tube 25, for which purpose the valve 39 is opened and the valves 38, 40, 41, 48, and 57 are closed.

Via these two steps 1 and 2, on the one hand a gentle preheating of the bottles 20 is assured, and on the other hand condensate (water) that has possibly been deposited on the surfaces of the bottle 20 is carried of to the outside by the steam stream through the opening formed between the bell-shaped portion 26 and the bottle plate 27. This is especially true during step 2 also for such condensate that has possibly formed in the interior of the bottle 20.

3. As soon as the bottle plate 27 rests tightly against the bell-shaped portion 26 and seals off the same, the bottle 20 and the bell-shaped portion 26, with the liquid flow valve still closed, are pressurized with steam, for example saturated steam at 130° C., whereby the valves 38–41, 48, and 57 have the same position as in step 2. With the bell-shaped portion 26 closed, a steam discharge is then effected via the throttle mechanisms 55 and 56 into the collecting channel 54.

4. The condition described in step 3 is maintained for a period of time of, for example, three seconds, i.e. over an angle of rotation of the rotor that corresponds to this period of time, with this condition being maintained until a satisfactory sterilization of the bottle 20 under the high steam pressure, for example 1.7 bar, that exists in the bell-shaped portion 26 is assured, with the throttle mechanism 56 being closed after approximately one second.

5. With the liquid flow valve still closed, a pressurizing of the closed bell-shaped portion 26, and hence also of the bottle 20, is effected with an inert gas (for example $CO_2$) or with sterile air. In this connection, the valves 38–41, 48, and 57 are closed, and the valve 69 is opened, with a reduced stream of sterile air or inert gas being provided out of the bell-shaped portion 26 via the throttle mechanism 55 and the check valve 53.

6. With the previously described steps, the sterilization phase (method steps 1–4), as well as the pressurizing phase (step 5) that also precedes the actual filling phase, are concluded, so that approximately at the position II in FIG. 1, the filling phase is initiated by opening the filling valve of the pertaining filling element 8 by activating the actuating device 13 via the electronic control mechanism 18. At this start of the filling phase, all of the valves 38–41, 48, 57, and 69 are closed, so that the liquid material flows into the bottle 20 via the filling tube 25, and in particular accompanied by a corresponding displacement of the inert gas or sterile air that is present there and that flows off via the throttle mechanism 55 into the collecting channel 54, as a result of which initially a slow supply of liquid material results, i.e. a filling at low filling speed is effected at this stage.

7. After the bottom end of the filling tube 25 is immersed in the liquid level, there is then effected, with the liquid flow valve still open, a filling at increased filling speed, and in particular with the valves 38–41, 48, and 69 closed and the valve 57 opened, so that the inert gas or air displaced from the material can flow off into the collecting channel 54 via the two throttle mechanisms 55 and 56.

8. After the conclusion of the rapid filling phase (step 7), and with the liquid flow valve still open, the braking or slowing phase is initiated, and in particular by closing the valve 57 and with the valves 38–41, 48, and 69 also still closed.

9. After the response of a filling state sensor that controls the electronic control mechanism 18 and that in the illustrated embodiment is formed by a sensor 74 that is provided in the respective bell-shaped portion 26 and extends through the mouth into the bottle 20 that is to be filled, there is effected, with the liquid flow valve still open and the valves 38–41, 48, 57, and 69 closed, a correction phase, for example in such a way that for a prescribed period of time the electronic control mechanism 18 keeps the liquid flow valve open.

10. After the correction time has elapsed, and with the valves 38–41, 48, 57, and 69 still being closed, the liquid flow valve of the pertaining filling element 8 is also closed, whereby then the pressure in the bell-shaped portion 26 is also reduced via the throttle mechanism 55.

As previously described, the sensor 74 initiates the closure of the liquid flow valve of the pertaining filling element 8 via the correction phase. With an appropriate construction, this sensor can also serve to initiate the braking or slowing phase (step 8) that relates to the filling state. If the sensor 74 is embodied as a conducting contact, in this case the sensor 74, in addition to a common electrode, has two control electrodes that are disposed one above the other in the vertical direction, with the lower electrode initiating the slowing phase when it becomes immersed in the liquid level, and with the upper electrode initiating the closure of the liquid flow valve via the correction phase when this electrode becomes immersed in the liquid level.

11. With the liquid flow valve closed, the valves 38, 39, 48, 57, and 69 closed and the valves 40 and 41 opened, the draining of the filling tube 25 is effected accompanied by a simultaneous reduced supply of steam into the bell-shaped portion 26, and in particular via the opened valve 40 and the throttle mechanism 43, whereby the counterpressure present in the bell-shaped portion 26 during the filling process is reduced via the throttle mechanism 55. The bottle plate 27 is subsequently lowered.

12. When the bottle plate 27, and hence also the filled bottle 20, are lowered to such an extent that the lower end of the filling tube 25 emerges from the liquid level, with a continuing reduced steam stream into the bell-shaped portion 26, i.e. with the valve 40 still open, the valve 38 is also opened, so that then also for the complete draining of the filling tube 25 a reduced steam stream results through the channel 24 of this filling tube 25, and in particular preferably during the further lowering of the bottle plate 27 and the filled bottle 20. The valves 39, 41, 48, 57, and 69 are closed.

13. The filled bottle 20 is ejected or discharged at the position III and is conveyed via the transport element 65 to the closing or capping mechanism 66. During this discharge of the filled bottles 20 the valves 38–41 48 57, and 69 remain in the position indicated for step 12, so that a reduced steam stream continues through the channels 31 and the channel 24 of the filling tube 25.

14. Between the positions III and I, the respective bell-shaped portion 26 is closed except for a narrow annular gap that is formed between its bottom, open end and the fixed plate 75. The position of the valves 38–41, 48, 57, and 69 described in conjunction with step 12 is maintained, so that a reduced steam stream continues through the channels 31 and the channel 24 of the filling tube 25, as a result of which the steam that escapes via the annular gap between the bell-shaped portion 26 and the plate 75 acts upon the interior and inner surfaces of the bell-shaped portion 26 as well as on the outer and inner surfaces of the filling tube 25. The use of the plate 75 has the particular advantage that with this step, the steam atmosphere within the respective bell-shaped portion 26 is maintained, and thus, also taking into consideration the dimension or width of the annular gap formed between the lower rim of the bell-shaped portion 26 and the plate 75, no atmospheric air, bacteria, impurities, etc. can enter the bell-shaped portion 26 from the outside.

As the above explanation shows, with the method pursuant to Example II, where the conduit 46 is dispensed with, no removal of the sterilization medium is required at the end of the sterilization phase. Rather, in this case the pressurizing is effected immediately after the sterilization phase i.e. after step 4.

In place of the plate 75 described above, it would also be possible to provide another element to form the annular gap described in step 17 of Example I or in step 14 of Example II. Furthermore, it is also possible, in place of the plate 75, to dispose between the positions III and I a pan or trough-like element that has an outlet. If a cleaning of the respective bell-shaped portion 26 as well as of the filling tube 25 with a cleaning fluid (water) is to be effected between the positions III and I, the plate 75 is therefore eliminated or, in place of the plate 75, the already addressed trough-like element is provided for collecting and withdrawing the cleaning fluid.

Instead of the sealing means 29 at the respective bottle plate 27, it is also possible to provide an appropriate sealing means at the lower, open end of the respective bell-shaped portion 26. Furthermore, in place of the sensor or probe 74, it is also possible to embody the filling tube 25 as a probe, or to provide the filling tube 25 with an appropriate probe contact.

The present invention is, of course, in no way restricted to the specific disclosure of the specification and drawings, but also encompasses any modifications within the scope of the appended claims.

What I claim is:

1. An apparatus for dispensing a liquid under counterpressure into a container, which may break due to temperature shock, in an aseptic or sterile manner, whereby said container that is to be filled is acted upon, at least during a portion of a sterilization phase that precedes a filling phase where said container is filled with said liquid, by a hot, gaseous or vaporous sterilization medium that is under pressure, said apparatus comprising:

a container entry mechanism at a container entry position for supplying containers that are to be filled;

a container outlet mechanism at a container discharge position for the discharge of filled and capped containers;

a rotor that rotates about a vertical axis of rotation;

a plurality of filling elements that are disposed about the periphery of said rotor, with each of said filling elements including a liquid flow valve for controllably dispensing said liquid via a liquid channel and a filling tube that is connected thereto and has an exit on its lower end:

a plurality of container supports, with each container support being associated with one of said filling elements and being movable toward and away from said filling element in a vertical direction with said containers that are to be led being delivered to said rotor at said container entry position and being withdrawn from said rotor at said container discharge position;

a plurality of bell-shaped portions provided on said rotor, each of said bell-shaped portions defining a chamber and being disposed below one of said filling elements and having a closed upper end adjacent to the filling element and an open bottom end that is remote from said filling element;

on each side of said filling element, delivery means for delivering said hot sterilization medium under pressure, said delivery means including at least one control valve arrangement and serving for supplying said sterilization medium to said container and to said bell-shaped portion during said sterilization phase;

a mechanism for closing or capping said containers after the same have been filled with the liquid:

each chamber formed by the interior of one of the bell-shaped portions having a height that is at least somewhat greater than the height of a container that is to be filled;

means for closing off said open bottom end of each bell-shaped portion to the atmosphere by said container support at said sterilization phase as well as at said filling phase for accommodating said container that is to be filled completely in said closed chamber in such a way that the interior of said container communicates via a mouth of said container with the interior of said bell-shaped portion;

said control valve arrangement having a first portion, and said liquid channel having a portion that in the direction of flow of said liquid is disposed after said liquid flow valve and that is adapted to communicate via said first portion of said control valve arrangement with said sterilization medium delivery means for introducing said sterilization medium via said filling tube and said exit thereof into said interior of said container;

the length of each filling tube, which extends through said mouth of said container into the interior thereof during the sterilization phase and the filling phase, being such that said exit of said filling tube is positioned directly at the bottom of a container that is to be filled at the sterilization phase and at the filling phase when the open bottom end of the respective bell-shaped portion is closed off;

said first portion of said control valve arrangement is formed by a first valve with which is preferably connected in parallel a series arrangement of a second valve and a first throttle mechanism; and on an inner surface of said bell-shaped portion facing said open end thereof at least one additional discharge channel is provided that is adapted to be connected to said sterilization medium delivery means via a second portion of said control valve arrangement that is formed by a third valve, with a second throttle mechanism preferably being disposed in series with said third valve.

2. An apparatus according to claim 1, which includes a plurality of said additional discharge channels that are connected to a common channel, with said additional discharge channels preferably each opening at a different angle into the interior of said bell-shaped portion; and in which said common channel communicates with said second portion of said control valve arrangement.

3. An apparatus according to claim 1, in which said at least one additional discharge channel, as well as said portion of said liquid channel that in the direction of flow of said liquid is disposed after said liquid flow valve, are adapted to be connected via a third portion of said control valve arrangement that is formed by at least one fourth valve.

4. An apparatus according to claim 3, in which the interior of said bell-shaped portion is adapted to be connected via at least one fifth valve with a supply mechanism for supplying a pressurizing gas, for example inert gas or sterile air, that is under pressure.

5. An apparatus according to claim 4, in which the interior of each bell-shaped portion is connected to a return gas line that is provided with at least one throttle mechanism.

6. An apparatus according to claim 5, in which, parallel to said at least one throttle mechanism, a conduit section is provided that includes at least one sixth valve, preferably a sixth valve in series with a throttle mechanism.

7. An apparatus according to claim 6, in which connected to each bell-shaped portion is a conduit that is provided with a seventh valve and that communicates with a source for a partial vacuum.

8. An apparatus according to claim 7, in which said conduits of all of said bell-shaped portions, which conduits are provided with said seventh valve, are connected to a common collecting channel that is in turn connected with said source for partial pressure.

9. An apparatus according to claim 7, in which said fifth, sixth, and/or seventh valve, similarly forms a portion of said control valve arrangement.

10. An apparatus according to claim 9, in which said valves that form said portions of said control valve arrangement are individual valves.

11. An apparatus according to claim 9, in which said valves that form said portions of said control valve arrangement are at least in part formed by a common valve member, for example a slide plate of a control valve that is provided with numerous working or operating positions.

12. An apparatus according to claim 9, in which said control valve arrangement has at least six operating positions, namely a first operating position where all of said valves are closed, as well as five further operating positions in which, with the exception of those valves specifically mentioned, the remainder of the valves are closed, namely a second operating position in which said first and third valves are opened, a third operating position in which said second valve is opened, a fourth operating position in which said third and fourth valves are open, a fifth operating position in which said third valve is opened, and a sixth operating position in which said sixth valve is opened.

13. An apparatus according to claim 12, in which said control valve arrangement is additionally provided with a seventh and eighth operating position is which, with the exception of the specifically mentioned valves, the rest of the valves are closed, namely a seventh operating position in which said fifth valve is open, and an eighth operating position in which said seventh valve is opened.

14. An apparatus according to claim 5, in which said return gas lines of all of said bell-shaped portions are connected to a common collecting channel, preferably via respective check valves.

15. An apparatus according to claim 1, which includes a preheater that is disposed between said container entry mechanism and said entry position of said rotor and via which preheated containers are delivered to said entry position.

16. An apparatus according to claim 1, in which said container supports are movable relative to the respective filling element in a vertical direction between at least three positions in such a way that in a first position, the mouth of a respective container that is disposed on a container support is disposed below the lower end of said filling tube as well as of said bell-shaped portion, in a second position, with said container being disposed in the interior of said bell-shaped portion, an annular gap is formed between said lower end of said bell-shaped portion and said container support, and in the third position, said container support rests sealingly against said bottom end of said bell-shaped portion.

17. An apparatus according to claim 16, in which each container support closes-off the pertaining bell-shaped portion at least during a portion of said sterilization phase as well as during said filling phase.

18. An apparatus according to claim 16, in which at the beginning of said sterilization phase or during a preheating phase that precedes said sterilization phase, each container support is spaced from said open bottom end of the pertaining bell-shaped portion.

19. An apparatus according to claim 1, in which said sterilization medium delivery means is connected with a source of steam, preferably saturated steam.

20. An apparatus for dispensing a liquid under counterpressure into a container, which may break due to temperature shock, in an aseptic or sterile manner, whereby said container that is to be filled is acted upon, at least during a portion of a sterilization phase that precedes a filling phase where said container is filled with said liquid, by a hot, gaseous or vaporous sterilization medium that is under pressure, said apparatus comprising:

a container entry mechanism at a container entry position for supplying containers that are to be filled;

a container outlet mechanism at a container discharge position for the discharge of filled and capped containers;

a rotor that rotates about a vertical axis of rotation;

a plurality of filling elements that are disposed about the periphery of said rotor, with each of said filling elements including a liquid flow valve for controllably dispensing said liquid via a liquid channel and a filling tube that is connected thereto and has an exit on its lower end;

a plurality of container supports, with each container support being associated with one of said filling elements and being movable toward and away from said filling element in a vertical direction, with said containers that are to be filled being delivered to said rotor at said container entry position and being withdrawn from said rotor at said container discharge position;

a plurality of bell-shaped portions provided on said rotor, each of said bell-shaped portions defining a chamber and being disposed below one of said filling elements and having a closed upper end adjacent to the filling element and an open bottom end that is remote from said filling element;

on each side of said filling elements, delivery means for delivery said hot sterilization medium under pressure, said delivery means including at least one control valve arrangement and serving for supplying said sterilization medium to said container and to said bell-shaped portion during said sterilization phase;

a mechanism for closing or capping said containers after the same have been filled with the liquid;

each chamber formed by the interior of one of the bell-shaped portions having a height that is at least somewhat greater than the height of a container that is to be filled;

means for closing off said open bottom end of each bell-shaped portion to the atmosphere by said container support at said sterilization phase as well as at said filling phase for accommodating said container that is to be filled completely in said closed chamber in such away that the interior of said container communicates via a mouth of said container with the interior of said bell-shaped portion;

said control valve arrangement having a first portion, and said liquid channel having a portion that in the direction of flow of said liquid is disposed after said liquid flow valve and that is adapted to communicate via said first portion of said control valve arrangement with said sterilization medium delivery means for introducing said sterilization medium via said filling tube and said exit thereof into said interior of said container;

the length of each filling tube, which extends through said mouth of said container into the interior thereof during the sterilization phase and the filling phase, being such that said exit of said filling tube is positioned directly at the bottom of a container that is to be filled at the sterilization phase and at the filling phase when the open bottom end of the respective bell-shaped portion is closed off; and said mechanism for closing or capping said containers is provided beyond said rotor and, in the direction in which said containers are conveyed, ahead of said container outlet mechanism; and in which a mechanism for additionally supplying heat to the filled containers is provided between said container release position of said rotor and said mechanism for closing or capping said containers.

21. An apparatus for dispensing a liquid under counterpressure into a container, which may break due to temperature shock, in an aseptic or sterile manner, whereby sid container that is to be filled as acted upon, at least during a portion of a sterilization phase that precedes a filling phase where said container is filled with said liquid, by a hot, gaseous or various sterilization medium that is under pressure, said apparatus comprising:

a container entry mechanism at a container entry position of for supplying containers that are to be filled;

a container outlet mechanism at a container discharge position for the discharge of filled and capped containers;

a rotor that rotates about a vertical axis of rotation;

a plurality of filling elements that are disposed about the periphery of said rotor, with each of said filling elements including a liquid flow valve for controllably dispensing said liquid via a liquid channel and a filling tube that is connected thereto and has an exit on its lower end;

a plurality of container supports, with each container support being associated with one of said filling elements and being movable toward and away from said filling element in a vertical direction, with said containers that are to be filled being delivered to said rotor at said container entry position and being withdrawn from said rotor at said container discharge position;

a plurality of bell-shaped portions provided on said rotor, each of said ball-shaped portions defining a chamber and being disposed below one of said filling elements and having a closed upper end adjacent to the filling element and an open bottom end that is remote from said filling element;

on each side of said filling elements, delivery means for delivering said hot sterilization medium under pressure, said delivery means including at least one control valve arrangement and serving for supplying said sterilization medium to said container and to said bell-shaped portion during said sterilization phase;

a mechanism for closing or capping said containers after the same have been filled with the liquid;

each chamber formed by the interior of one of the bell-shaped portions having a height that is at least somewhat greater than the height of a container that is to be filled;

means for closing off said open bottom end of each bell-shaped portion to the atmosphere by said container support at said sterilization phase as well as at said filling phase for accommodating said container that is to be filled completely in said closed chamber in such a way that the interior of said container communicates via a mouth of said container with the interior of said bell-shaped portion;

said control valve arrangement having a first portion, and said liquid channel having a portion that in the direction of flow of said liquid is disposed after said liquid flow valve and that is adapted to communicate via said first portion of said control valve arrangement with said sterilization medium delivery means for introducing said sterilization medium via said filling tube and said exit thereof into said interior of said container;

the length of each filling tube, which extends through said mouth of said container into the interior thereof during the sterilization phase and the filling phase, being such that said exit of said filling tube is positioned directly at the bottom of a container that is to be filled at the sterilization phase and at the filling phase when the open bottom end of the respective bell-shaped portion is closed off; and a stationary element, which is a flat plate, is disposed between said container discharge position and said container entry position in such a way that each of said bell-shaped portions is closed between said container discharge position and said container entry position with the exception of a narrow annular gap that is formed between said element and said open bottom end of said bell-shaped portion.

* * * * *